United States Patent [19]

Lothamer et al.

[11] Patent Number: 4,819,142

[45] Date of Patent: Apr. 4, 1989

[54] VEHICLE LAMP ASSEMBLY AND RETAINER

[75] Inventors: Robert J. Lothamer, Sterling Heights; James L. Purpura, Canton, both of Mich.

[73] Assignee: Chrysler Motors Corporation, Highland Park, Mich.

[21] Appl. No.: 153,749

[22] Filed: Feb. 8, 1988

[51] Int. Cl.[4] ..... H01R 33/00

[52] U.S. Cl. ..... 362/226; 362/61; 439/559

[58] Field of Search ..... 362/226, 61, 80; 439/553, 556, 557, 558, 559

[56] References Cited

U.S. PATENT DOCUMENTS

| | | | |
|---|---|---|---|
| 2,825,051 | 2/1958 | Seever | 340/367 |
| 4,470,104 | 9/1984 | Cox | 362/211 |
| 4,506,943 | 3/1985 | Drogo | 339/90 R |
| 4,507,712 | 3/1985 | Dolan et al. | 362/61 |
| 4,509,814 | 4/1985 | Mattingly, Jr. | 439/93 R |
| 4,528,619 | 7/1985 | Dolan et al. | 362/61 |
| 4,530,559 | 7/1985 | Burns et al. | 439/90 R |
| 4,547,032 | 10/1985 | Burns et al. | 439/90 R |
| 4,552,427 | 11/1985 | Landgreen | 339/89 M |
| 4,584,634 | 4/1986 | Gigity, Jr. | 362/275 |
| 4,586,775 | 5/1986 | Nestor et al. | 439/97 R |
| 4,599,681 | 7/1986 | McMahon et al. | 362/80 |
| 4,602,836 | 7/1986 | Garretson et al. | 339/59 R |
| 4,602,839 | 7/1986 | Winger | 439/91 R |
| 4,605,991 | 8/1986 | Fylan | 362/65 |
| 4,679,128 | 7/1987 | Van Duyn et al. | 362/61 X |
| 4,682,274 | 7/1987 | Freudenreich et al. | 362/226 X |
| 4,760,506 | 7/1988 | Mochizuki et al. | 362/226 |
| 4,764,854 | 8/1988 | Matsune et al. | 439/559 X |

*Primary Examiner*—Ira S. Lazarus
*Assistant Examiner*—Peggy Neils
*Attorney, Agent, or Firm*—Edward A. Craig

[57] ABSTRACT

A vehicle lamp assembly includes a retainer for a head lamp socket received within a receptacle in a reflector. The retainer has a body with a central opening and slots peripherally spaced around the opening to correspond with a predetermined alignment of projections on the socket body. The head lamp assembly can include high beam and low beam bulb and socket assemblies having distinguishable predetermined alignments of projections, and the retainer is particularly configured to inhibit forced installation of an incompatible socket within the receptacle. The retainer ring includes fingers adjacent each slot in a first circumferential direction for retaining each socket projection in pressed engagement against the reflector. An auxiliary nub is formed on at least one finger to restrict displacement of the projection from the finger toward the slot. A guide nub is formed between at least one slot and its adjacent finger to prevent cocked insertion of a non-compatible socket through the retainer and into an improper receptacle. A stop lug associated with the retainer includes a radially inward surface adjacent the periphery of the central opening in the retainer to prevent off-axis alignment of an improper socket within a lamp receptacle. The stop lug also includes a radially aligned abutment surface adjacent the end of a finger to prevent excessive rotation of the socket during installation.

2 Claims, 2 Drawing Sheets

VEHICLE LAMP ASSEMBLY AND RETAINER

BACKGROUND OF THE INVENTION

I. Field of the Present Invention

The present invention relates generally to vehicle lamps having a bulb and socket assembly, the bulb of which is insertable into a reflector receptacle, and more particularly to a retainer for retaining the socket portion and preventing forced insertion of incompatibly configured sockets.

II. Description of the Prior Art

In order to overcome production and packaging expenses for large sealed beam vehicle headlamps, it has been considered advantageous to reduce the size of the envelope enclosing a lamp filament and to support the smaller envelope within an enlarged reflector assembly. One known type of such insertable lamps includes a socket housing which is adapted to be received within a receptacle in the reflector. Nevertheless, while the envelope and socket structure are readily available from the lamp manufacturer, the means for mounting the assembly in the receptacle has been left to the vehicle manufacturer as a durable part of the vehicle which does not require repeated replacement.

U.S. Pat. Nos. 4,528,619 and 4,507,712 to Dolan et al. disclose a light bulb socket and a reflector assembly in which the receptacle for the socket includes projections adapted to be received in slots formed peripherally on the socket body. The socket is retained in its inserted position by a cap having a lip which engages a peripheral groove on the socket and a resilient base segment engaging a rear surface of the socket. The patents also disclose that the cap may be provided with projecting segments which are received in recesses of an upstanding flange on the socket so that once the flange has passed the end of the cap, the socket can be rotated slightly so that the flange is retained under the projections.

These previously known constructions are disadvantageous for the reason that the formation of projections on the reflector and the cap as well as corresponding slots in the body of the socket substantially complicates the production of each of those components. In addition, high beam and low beam sockets may be formed with the same type of construction, and the references do not teach or suggest any means for avoiding inadvertent or forced installation of an improperly selected lamp socket within a receptacle intended for another lamp socket.

One previously known socket construction intended to avoid installation of an improperly selected socket within the receptacle involves the use of different diameter sockets for high and low beam lamp assemblies. Accordingly, the reflectors are constructed with receptacles correspondingly sized to receive the different sockets. Nevertheless, while it may be appreciated that the larger socket body could not be fit into the smaller receptacle, it would still be possible for a smaller socket to be received within the larger diameter receptacle.

A further previously known feature intended avoid such insertion involves the formation of an expanded flange on the lamp socket having projections in a predetermined alignment and wherein the predetermined alignment of the projection on the high beam socket differs from the circumferential spacing of the projections in the predetermined alignment on the low beam socket. However, in practice it has been found that known, available high beam and low beam socket structures have predetermined alignments which differ only by a slight offset of one of the projections, while the remaining two projections on each socket body remain similarly aligned. Moreover, the single projection on each type of socket which has been offset is offset only through a small angular variation such that it would still be possible to force installation of an improperly selected small diameter socket within a larger diameter receptacle by cocking or twisting the socket so as to align the offset projection with the slightly offset slot.

Thus, the previously known socket constructions have not eliminated the possibility of defective vehicle assembly by forced installation of improperly selected sockets in a receptacle. The inability to preclude such improper installation can cause substantial difficulties in the mass production of motor vehicles as well as in repair and replacement of the lamp sockets as is often required in normal maintenance.

SUMMARY OF THE PRESENT INVENTION

The present invention overcomes the above mentioned disadvantages by providing a vehicle lamp assembly in which a retainer ring cooperates with the reflector to receive only the particular socket designed to be inserted within the receptacle of a reflector. With the present invention, this is accomplished by means for indexing the retainer with respect to the reflector as well as indexing means for receiving only a predetermined configuration of a socket to the exclusion of similarly constructed sockets.

The invention provides fail-safe installation features without complicated construction of the receptacle formed within the reflector, and eliminates the need for redesign of the light sockets readily available from manufacturers, by incorporating one or more fail-safe features on a retaining ring adapted to be mounted to the reflector. The retainer includes indexing means for seating the retainer in a predetermined alignment on a predetermined reflector support mount but which does not permit the retainer to seat on an incompatible reflector construction. In addition, the retainer includes indexing means for receiving only a socket having properly aligned projections even though a smaller diameter socket is selected and even though the offset of a projection in a predetermined alignment on one of the high beam and low beam sockets varies only slightly from the position of a similar projection in a predetermined alignment on the other lamp socket.

In general, the retainer ring has a body with a central opening and configurations at the periphery of the opening, which in the preferred embodiment are slots about the opening, corresponding with the positions of projections on a desired lamp socket. A finger on the body lies adjacent to each slot in a first circumferential direction. In the preferred embodiment, the retainer is a simple, one piece structure preferably formed from a stamped metal plate whereby the fingers are formed in one piece with the body of the retainer. The fingers resiliently bias the projections on the socket against the reflector. Each of the fingers may include a nub which assures proper spring tensioning of the finger against the projection.

At least one auxiliary nub is provided between the finger nub and the adjacent slot so that the projections are restricted from movement from said finger toward the slot. A guide nub can also be formed between a slot and the adjacent finger to prevent cocked insertion of the socket projections in order to force an offset projection through an unintended slot. Furthermore, at least one stop lug can be associated with each retainer to provide a radially inward facing surface at the periphery of the central opening to prevent off-axis positioning of a socket within the retainer opening. The stop lug also forms a radially aligned abutment surface to prevent excessive rotation of the socket within the retainer. The retainer ring also includes a depending flange to avoid rotation of the socket in the retainer past the slots in a direction opposite to the first installation direction.

Thus, the present invention provides a vehicle lamp assembly and retainer which is substantially easier to produce than some previously known replaceable lamp socket assemblies. In addition, the invention provides secure support for the removable sockets. Moreover, the invention avoids inadvertent or forced installation of an improperly selected socket in an unintended receptacle.

BRIEF DESCRIPTION OF THE DRAWING

The present invention will be more clearly understood by reference to the following detailed description of a preferred embodiment in which like reference characters refer to like parts throughout the views and in which.

DETAILED DESCRIPTION OF A PREFERRED EMBODIMENT

Figure 1:
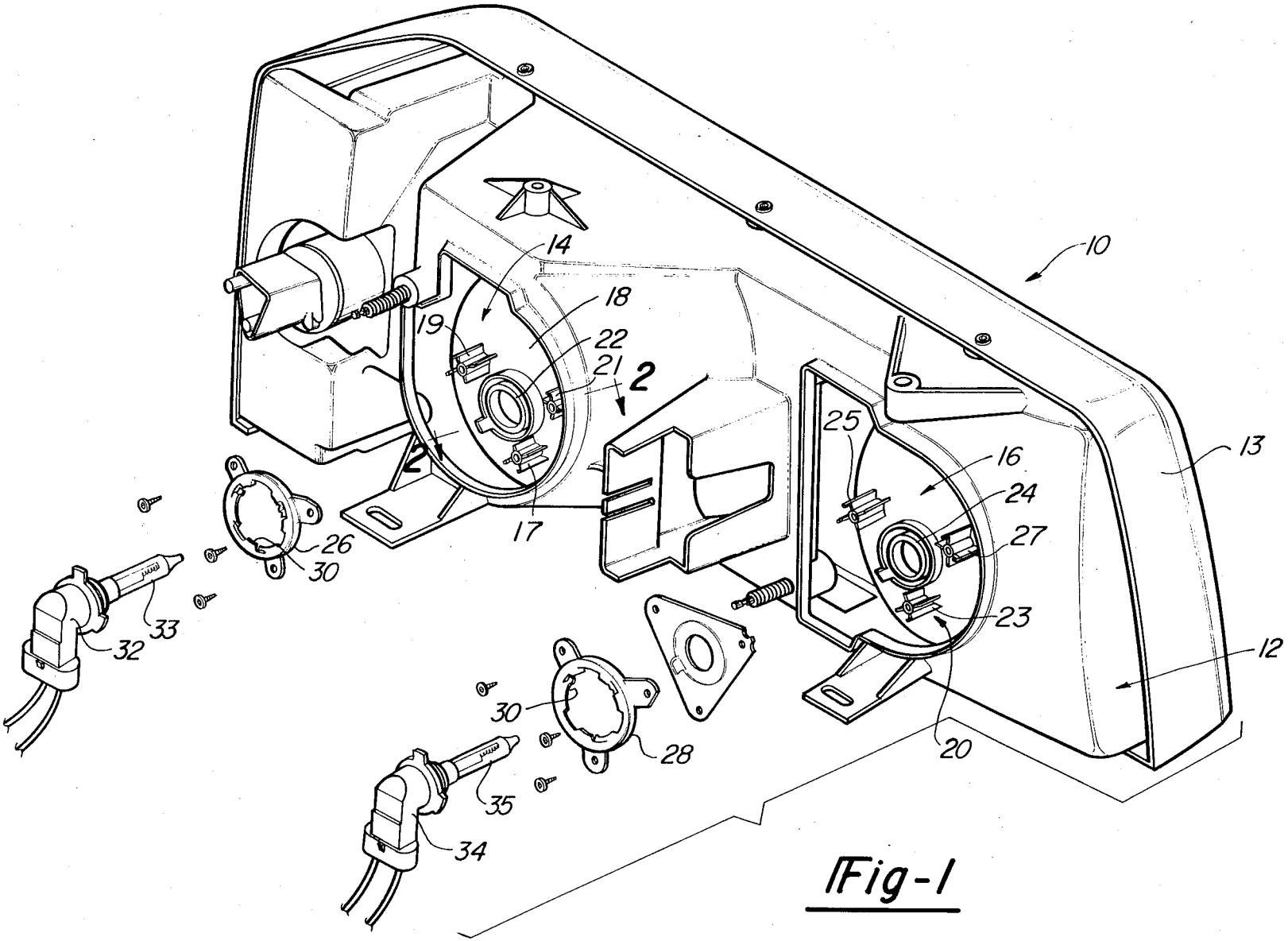
FIG. 1 is a exploded perspective view of a head lamp assembly constructed in accordance with the present invention.

Referring first to FIG. 1, a head lamp assembly 10 constructed in accordance with the present invention includes a housing 12 upon which is mounted a bezel 13. The housing 12 carries a low beam reflector 14 and a high beam reflector 16. Each reflector includes a support mounting 18 and 20, respectively, to be described in greater detail hereinafter. Nevertheless, each support mounting 18 and 20 includes three support stanchions 17,19,21 and 23,25,27 spaced about a light socket receptacle 22 and 24 respectively. Retainers 26 and 28 are bolted to the support stanchions 17,19,21 and 23,25,27 so that a central opening 30 in each of the retainers 26 and 28 is axially aligned with the receptacles 22 and 24 respectively. The openings in the retainers 26 and 28 receive lamp sockets 32 and 34, respectively, with the bulbs 33 and 35 of the bulb and socket assemblies being inserted into the receptacles 22 and 24.

Figure 2:
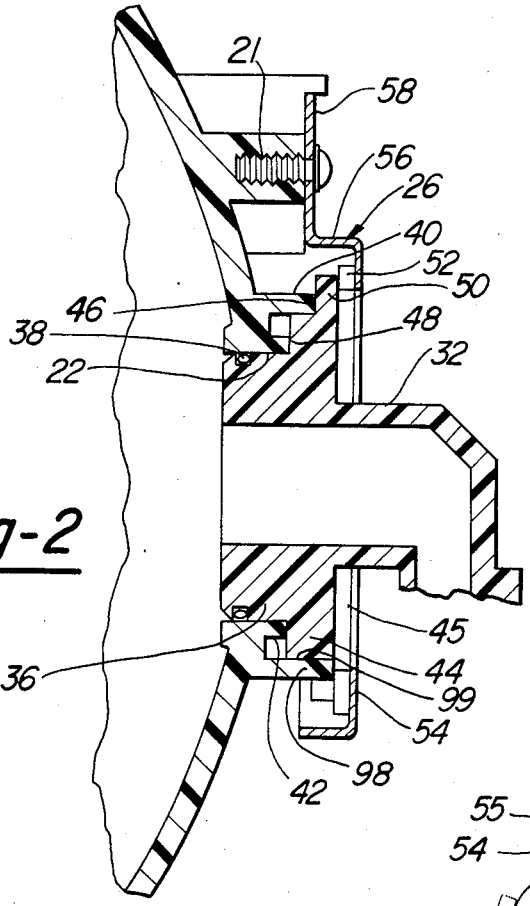
FIG. 2 is a enlarged sectional view taken substantially along the line 2—2 in FIG. 1.

The assembly of these components is best shown in FIG. 2 where structural details of the receptacle 22 are shown. In the preferred embodiment, it is to be understood that the receptacles 22 and 24 have substantially identical structures except for the particular features to be discussed in greater detail hereinafter. The primary difference between the receptacles is that the diameter of the receptacle 22 is larger than the diameter of the receptacle 24 in correspondence with the feature that the leading portion 36 of the lamp socket 32 is larger than the diameter of the leading portion 36 of the lamp socket 34. As a result, it is to be understood that FIG. 2 represents a typical sectional view through both the low beam portion and the high beam portion of the lamp assembly 10. In any event, the leading portion 36 of each socket 32 or 34 is sealed against the periphery of its respective receptacle by a seal ring 38.

Support for the socket 32 installed within the receptacle 22 includes a peripheral rim 40 about the receptacle 22 as well as a strengthening rib 42 which engage portions of the socket. An enlarged diameter flange 44 on the socket 32 rests against the rim 40 and rib 42 as shown at 46 and 48 in FIG. 2. A similar flange 44 is also included on the socket 34 and has a like engagement with the receptacle 24. While each flange 44 includes a different predetermined alignment of a plurality of projections, to be described in greater detail hereinafter, FIG. 2 demonstrates a typical cross section though a projection 50 as it is pressed against the end of the rim 40 by a finger nub 52.

Figure 3:
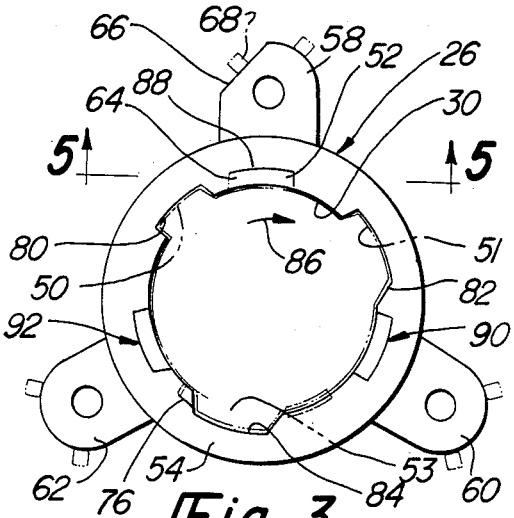
FIG. 3 is a plan view of a retainer shown in FIG. 1 and constructed in accordance with the present invention.

Referring now to FIG. 3, the retainer 26 includes a generally flat body 54 supported by a raised wall 56 (FIG. 2) supporting the body on three mounting tabs 58, 60 and 62. Each of the tabs rests upon a support stanchion 17,19,21 of the support mounting 18. Each of the support stanchions include raised locating lugs to peripherally entrain a tab on the support stanchion. One lug 68 on one support stanchion 21 is offset from a symmetrical arrangement of the lugs to define a predetermined alignment for attachment of the retainer 26 to the support mounting 18. Accordingly, tab 58 is truncated along one side as shown at 66 so as to rest against the radially recessed locating lug 68 on one stanchion. As a result, the retainer is constructed in cooperation with the support mounting 18 to provide a first indexing means for seating the tabs, and thus the retainer, in a predetermined alignment only.

Figure 4:
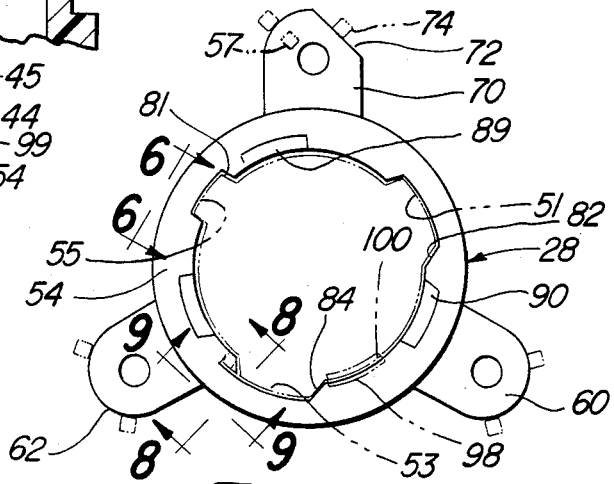
FIG. 4 is a plan view of another retainer shown in FIG. 1 and constructed in accordance with the present invention.

In a similar manner, as shown in FIG. 4, the flat body 54 of retainer 28 includes a tab 70 and as well as tabs 60 and 62. However, the tab 70 is truncated along the side 72 so as to bear against the offset, radially recessed lug 74 on one of the stanchions 27 of support mounting 20. As a result, it will be understood that the retainer 28 includes a second indexing means for seating the retainer in a particular alignment on the support mounting 20.

Furthermore, the differing truncations on the tabs 58 and 70 preclude seating of the retainer 28 upon the support mounting 18 for the receptacle 22, since as diagrammatically indicated at 57, lug 68 would form an obstruction preventing seating of the tab 70 on the support mounting 18 for the low beam receptacle 22. In a like manner, the recessed lug 74 would prevent seating of the tab 58 on the set of stanchions 21,23,25 for supporting a retainer over the high beam receptacle 24. As a result, each indexing means seats the retainer in a predetermined alignment on one support mounting exclusively of the other support mounting. In the preferred embodiment, the tabs 58 and 70 include truncations which are shaped substantially as a mirror image of each other.

Referring again to FIG. 3, the body 54 of retainer 26 includes a plurality of circumferentially spaced slots in communication with the central opening 30. The slots are shaped and positioned to correspond with socket projections which have provided by the lamp socket manufacturer. In the preferred embodiment, a slot 80 is adapted to receive a projection 50 (shown in phantom line) of the socket 32 while slots 82 and 84 are positioned and shaped to correspond with projections 51 and 53 (shown in phantom line) on the socket 32.

Adjacent each of the slots 80, 82 and 84 in the direction of arrow 86 shown in FIG. 3 is a spring finger. Each finger resiliently biases a projection, which has been inserted through the adjacent slot and rotated to an installed position beneath the finger, into engagement with the rim 40 as shown in FIG. 2. The resiliency of the retainer body material can be conveniently utilized for the resilient biasing by the formation of the nub 52. Preferably, the height of the nub corresponds to the axial length of the projection.

Figure 5:
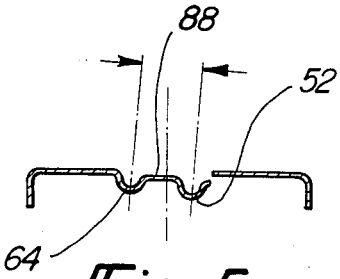
FIG. 5 is a sectional view taken substantially along the line 5—5 in FIG. 3.

A typical section of the nub 52 formed in each finger 88, 90 and 92 of the preferred embodiment during stamping is shown in FIG. 5.

As is also shown in FIG. 5, the finger 88 also includes an auxiliary nub 64 which inhibits displacement of the projection 50 toward the slot 80 once the projection 50 has been inserted through the slot and rotated beneath the body 54 of the retainer ring.

As also shown in FIG. 3, a guide nub 76 is formed on the body 54 between the slot 84 and the finger 92. The guide nub 76 can be formed as a depression in the body 54 so as to provide an abutment surface as discussed in greater detail hereinafter with respect to FIGS. 7 and 8. Nevertheless, it is to be understood that the guide nub 76 restricts displacement of the projection 53 toward the finger 92 unless the socket 32 is properly aligned with the axis of the receptacle and the projection 53 rests against the end of the rim 40.

Referring again to FIG. 4, the body 54 of the retainer 28 also includes a plurality of circumferentially spaced slots adapted to receive projections on the socket 34. However, unlike the predetermined alignment of the slots 80, 82 and 84 disclosed in FIG. 3, a slot 81 in retainer 28 is offset with respect to the positions of the slots 82 and 84 to accommodate the offset positioning of the projection 55 with respect to the projections 51 and 53 as occurs in a high beam socket currently made available by a known manufacturer. While the offset of the projection 55 with respect to the projections 51 and 53 on the socket 32 is intended by the manufacturer to distinguish between a high beam socket and a low beam socket, this offset is only an acute angular difference between the relative positions of the projections 50 and 55 with respect to the projections 51 and 53. Consequently, it has been found that this arrangement alone does not prevent forced insertion of the high beam socket 34 past the low beam retainer 26.

Figure 7:
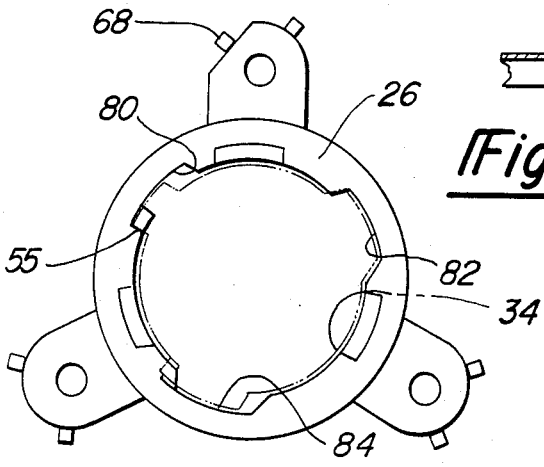
FIG. 7 is a diagrammatic view similar to FIGS. 3 and 4 but showing comparative alignments of the light assembly components shown in FIG. 1.
Figure 9:
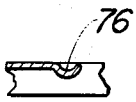
FIG. 9 is a sectional view taken substantially along the line 9—9 in FIG. 4.

As best demonstrated in FIG. 7, the slight offset between the projection 55 and the slot 80 can be overcome for several reasons. First of all, as exhibited in FIG. 2, a space 45 is provided between the body 54 of the retainer 26 and a flange 44 on the socket to be installed. Manufacturing tolerances in the formation of the space 45, the central opening 30 and other components can permit the socket 34 to be cocked and twisted or otherwise manipulated until the nonaligned projection 55 slips into the offset slot 80. Since the projections 51 and 53 fit within the slots 82 and 84 of the retainer 28, insertion of those projections through the slots may permit a socket to be eccentrically dislocated from the central axis of the receptacle 22 beneath the body of the ring so as to more nearly align the projection 55 with the slot 80 and the retainer 26. Moreover, by tilting the socket with respect to the central axis of the retainer opening, rotation of the partially inserted socket in the space 45 between the retainer and the reflector allows alignment of the projection 55 with the slot 80. Thus, the present invention provides additional features which avoid this problem of forced insertion.

Figure 8:
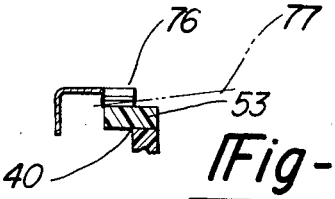
FIG. 8 is a sectional view taken substantially along the line 8—8 in FIG. 4.

As best shown in FIG. 8, the guide nub 76 prevents rotary displacement of a cocked or tilted socket by obstructing passage of the tab 53 past the guide nub 76 as diagrammatically illustrated in phantom line 77 in FIG. 8. However, as indicated in solid line in FIG. 8, uncocked positioning of the socket is required for the projection to pass the guide nub 76. Thus, the guide nub assures that only a socket having a projection 50 aligned accurately with the slot 80 can be accommodated by the retainer 26.

In addition, the stop lug 98 prevents eccentric positioning by providing a radially inward facing surface 99 adjacent the periphery of the central opening 30 in the retainer 26. As a result, the socket 34 cannot be displaced off-axis from the central axis of the receptacle 22 for realignment of the projection 55 with the slot 80 for forced insertion of the socket 34 through the retainer 26.

Figure 6:
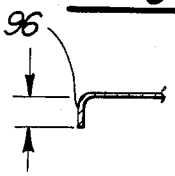
FIG. 6 is a sectional view taken substantially along the line 6—6 in FIG. 4.

An additional feature of the retaining rings 26 and 28 is shown in FIG. 6. At least one of the slots terminates at a depending flange 96. Such a flange prevents insertion of the socket beneath body portions which do not have fingers for resiliently retaining the socket against the receptacle rim. Rather, projections inserted into the slots can be rotated only .in the direction toward the fingers. As a result, the socket cannot be twisted in the wrong direction whereby it would be subjected to substantial vibration without any pressure holding it against the rim 40 of the reflector.

In addition, the stop lug 98 includes a radially aligned surface 100. The radial surface 100 faces toward the finger 90 to prevent excessive rotary displacement of a properly installed socket by abutting against the projection retained under the finger. In the preferred embodiment, the stop lug 98 is formed as an axial projection on the rim 40 surrounding each receptacle.

As a result, it will be understood that the vehicle lamp assembly and retainer of the present invention provides a stable and secure attachment of only a correspondingly configured socket within a reflector receptacle. Moreover, the present invention provides a head lamp assembly in which the retainers are indexed for installation on a support mounting surrounding only the receptacle corresponding to its compatible respective socket. Moreover, the retaining ring receives only the socket which properly corresponds to the receptacle at which it is secured so as to avoid inadvertent or forced installation of a non-compatible socket.

Having thus described the present invention, many modifications thereto will become apparent to those skilled in the art to which it pertains without departing from the scope and spirit of the present invention as defined in the appended claims.

What is claimed is:

1. A vehicle lamp assembly having:

a first reflector having a first receptacle and a first support mounting;

a second reflector having a second receptacle and a second support mounting;

a first light socket adapted to be received in said first receptacle;

a second light socket adapted to be received in said second receptacle;

first and second retainer rings having a central opening for receiving the light sockets to be inserted within the receptacles;

said first retainer and first support mounting having cooperating first indexing means for seating said retainer in a predetermined alignment on said first support mounting and exclusively of said second support mounting;

said second retainer and second support mounting having a cooperating second indexing means for seating said retainer in a predetermined alignment on said second support mounting and exclusively of said first mounting;

the first and second indexing means being defined by each said support mounting comprising a plurality of stanchions, each stanchion having raised locating lugs peripherally disposed about a seating surface, wherein at least one locating lug on said first support mounting is recessed from a symmetrical position with respect to the remaining lugs on said first support mounting, wherein at least one locating lug on said second support mounting is recessed from a symmetrical position with respect to the remaining lugs on said second support mounting, and wherein said first and second retainers having support tabs correspondingly positioned to seat against said seating surface of said stanchions, each said retainer including a truncated tab portion adjacent said at least one recessed lug on the respective support mounting;

third indexing means associated with said first retainer for receiving said first socket in a predetermined alignment through said first retainer exclusively of said second socket; and fourth indexing means associated with said second retainer for receiving said second socket in a predetermined alignment exclusively of said one of said first socket.

2. The invention as defined in claim 1 wherein said truncated portion on said first retainer is shaped as a mirror image of said truncated portion on said second retainer.

* * * * *